US010358244B2

(12) United States Patent
Wolf et al.

(10) Patent No.: US 10,358,244 B2
(45) Date of Patent: Jul. 23, 2019

(54) ROTATABLE SEALING JAW ASSEMBLY FOR A FORM, FILL AND SEAL MACHINE

(71) Applicant: TRIANGLE PACKAGE MACHINERY CO., Chicago, IL (US)

(72) Inventors: Michael T. Wolf, Chicago, IL (US); Vadim A. Lubezny, Buffalo Grove, IL (US); Luis F. Torres, Bellwood, IL (US); Ryan V. Lee, Chicago, IL (US); Jeffrey A. Hutsell, Sugar Land, TX (US)

(73) Assignee: TRIANGLE PACKAGE MACHINERY CO., Chicago, IL (US)

( * ) Notice: Subject to any disclaimer, the term of this patent is extended or adjusted under 35 U.S.C. 154(b) by 343 days.

(21) Appl. No.: 15/297,518

(22) Filed: Oct. 19, 2016

(65) Prior Publication Data

US 2017/0113823 A1 Apr. 27, 2017

Related U.S. Application Data

(60) Provisional application No. 62/246,340, filed on Oct. 26, 2015.

(51) Int. Cl.

| | |
|---|---|
| ***B65B 51/30*** | (2006.01) |
| ***B65B 59/00*** | (2006.01) |
| ***B65B 65/00*** | (2006.01) |
| ***B65B 9/207*** | (2012.01) |
| ***B65B 9/213*** | (2012.01) |

(52) U.S. Cl.

CPC ..... *B65B 51/303* (2013.01); *B65B 9/207* (2013.01); *B65B 9/213* (2013.01); *B65B 59/00* (2013.01); *B65B 65/00* (2013.01)

(58) Field of Classification Search

CPC ..... B65B 51/303; B65B 59/00; B65B 9/213; B65B 9/207; B65B 65/00

See application file for complete search history.

(56) References Cited

U.S. PATENT DOCUMENTS

| | | | |
|---|---|---|---|
| 1,926,060 | A | 9/1933 | Peters |
| 2,751,732 | A | 6/1956 | Woppman |
| 3,054,236 | A | 9/1962 | Stroop |
| 3,102,374 | A | 9/1963 | Lloyd et al. |
| 3,140,030 | A | 7/1964 | Stewart |
| 3,159,955 | A | 12/1964 | Thurlings |
| 3,262,349 | A | 7/1966 | Hollenton et al. |
| 3,266,216 | A | 8/1966 | Van Den Bos |

(Continued)

FOREIGN PATENT DOCUMENTS

| | | |
|---|---|---|
| GB | 1 334 616 | 10/1973 |

*Primary Examiner* — Michelle Lopez
*Assistant Examiner* — Chinyere J Rushing-Tucker
(74) *Attorney, Agent, or Firm* — Brinks Gilson & Lione

(57) ABSTRACT

A form, fill and seal machine includes a support frame having an L-shaped track with first and second track portions. A sealing jaw assembly includes first and second guides moveable along the track from a first position, wherein the first and second guides are positioned in the first track portion, to a second position, wherein the first and second guides are positioned in the second track portion. The sealing jaw assembly is rotated 90 degrees as the first and second guides are moved from the first position to the second position. A method of converting a form, fill and seal machine from a first configuration to a second configuration is also provided.

24 Claims, 8 Drawing Sheets

(56) References Cited

U.S. PATENT DOCUMENTS 3,287,199 A 11/1966 Virta
3,486,296 A 12/1969 Hechenleitner
3,486,424 A 12/1969 Tanner
3,611,657 A 10/1971 Inoue et al.
3,629,987 A 12/1971 Klopfenstein et al.
3,710,543 A 1/1973 Toss
3,761,016 A 9/1973 Pedersen
3,766,706 A 10/1973 Graham
3,774,509 A 11/1973 Heinzer
3,815,321 A 6/1974 Hartman
3,925,963 A 12/1975 Greenwalt et al.
3,941,037 A 3/1976 Reichert
3,983,682 A 10/1976 Scully
4,104,847 A 8/1978 Glandon et al.
4,120,235 A 10/1978 Beck et al.
4,136,505 A 1/1979 Putnam, Jr. et al.
4,144,694 A 3/1979 Stapp et al.
4,192,121 A 3/1980 Caudle
4,199,919 A 4/1980 Moscatelli
4,215,520 A 8/1980 Heinzer et al.
4,219,988 A 9/1980 Shanklin et al.
4,241,563 A 12/1980 Muller et al.
4,290,253 A 9/1981 Domke et al.
4,291,520 A 9/1981 Prince et al.
4,358,918 A 11/1982 Groom et al.
4,391,081 A 7/1983 Kovacs
4,501,109 A 2/1985 Monsees
4,506,494 A 3/1985 Shimoyama et al.
4,512,138 A 4/1985 Greenawalt
4,516,379 A 5/1985 Iain
4,524,566 A 6/1985 Hauers et al.
4,532,753 A 8/1985 Kovacs
4,537,008 A 8/1985 Benz
4,545,183 A 10/1985 Stohlquist et al.
RE32,018 E 11/1985 Domke et al.
4,558,779 A 12/1985 Schmitt et al.
4,563,862 A 1/1986 McElvy
4,566,250 A 1/1986 Matsumura et al.
4,571,236 A 2/1986 Adams
4,571,926 A 2/1986 Scully
4,578,931 A 4/1986 Roovers
4,580,392 A 4/1986 Lagerstedt et al.
4,603,540 A 8/1986 Kopp
4,608,797 A 9/1986 Shabram, Jr. et al.
4,608,808 A 9/1986 Ryan et al.
4,620,409 A 11/1986 McElvy
4,622,793 A 11/1986 Oki
4,630,429 A 12/1986 Christine
4,633,651 A 1/1987 Edmunds
4,662,152 A 5/1987 Simelunas et al.
4,663,653 A 5/1987 Patel
4,663,917 A 5/1987 Taylor et al.
4,663,971 A 5/1987 Bakula
4,709,183 A 11/1987 Lange
4,719,741 A 1/1988 Mabry
4,722,373 A 2/1988 Roovers
4,735,675 A 4/1988 Metz
4,750,313 A 6/1988 Kammler et al.
4,750,315 A 6/1988 Wadell
4,751,808 A 6/1988 Hadden
4,757,668 A 7/1988 Klinkel et al.
4,768,330 A 9/1988 Lane, Jr. et al.
479,400 A 10/1988 Hoskinson et al.
4,782,643 A 11/1988 Stark
4,800,703 A 1/1989 Goodman
4,803,827 A 2/1989 Posey et al.
4,807,741 A 2/1989 Simelunas et al.
4,815,253 A 3/1989 Kovacs et al.
4,840,009 A 6/1989 Rentmeester et al.
4,856,566 A 8/1989 Tisma
4,862,673 A 9/1989 Francioni
4,891,928 A 1/1990 James et al.
4,910,943 A 3/1990 Taylor et al.
4,924,656 A 5/1990 Kovacs et al.
4,938,003 A 7/1990 Seppala
4,947,618 A 8/1990 Schneider et al.
4,947,621 A 8/1990 Christine et al.
4,947,623 A 8/1990 Saito et al.
4,955,929 A 9/1990 Klapp
4,974,395 A 12/1990 McMahon
4,979,353 A 12/1990 Seppala
4,996,825 A 3/1991 Bacon et al.
4,999,974 A 3/1991 Kovacs et al.
5,001,891 A 3/1991 Abate
5,010,929 A 4/1991 Tisma
5,012,628 A 5/1991 Van Oord
5,031,383 A 7/1991 Hustad
5,058,634 A 10/1991 Tisma
5,062,253 A 11/1991 Bacon et al.
5,067,302 A 11/1991 Boeckmann
5,079,902 A 1/1992 Seko et al.
5,131,750 A 7/1992 Gravel et al.
5,167,107 A 12/1992 Terminella et al.
5,170,610 A 12/1992 Tisma
5,177,937 A 1/1993 Alden
5,185,984 A 2/1993 Tisma
5,191,750 A 3/1993 Kammler
5,203,145 A 4/1993 Kammler et al.
5,235,796 A 8/1993 Campbell, III et al.
5,241,806 A 9/1993 Ziegler et al.
5,251,422 A 10/1993 Goodman et al.
5,274,984 A 1/1994 Fukuda
5,279,098 A 1/1994 Fukuda
5,335,479 A 8/1994 Lemke et al.
5,343,671 A 9/1994 Tisma
5,347,795 A 9/1994 Fukuda
5,347,796 A 9/1994 Ziegler et al.
5,351,464 A 10/1994 Francioni
5,371,995 A 12/1994 Guttinger et al.
5,388,387 A 2/1995 McElvy
5,388,389 A 2/1995 Tisma
5,398,486 A 3/1995 Kauss et al.
5,460,258 A 10/1995 Tisma
5,488,815 A 2/1996 Abrams et al.
5,505,037 A * 4/1996 Terminella ..... B65B 9/20
53/133.4
5,511,363 A 4/1996 Doede
5,524,413 A 6/1996 Fukuda
5,524,420 A 6/1996 Ikuta
5,533,322 A 7/1996 Bacon et al.
5,537,798 A 7/1996 Fukuda et al.
5,540,032 A 7/1996 Sosnik et al.
5,540,035 A 7/1996 Plahm et al.
5,551,206 A 9/1996 Fukuda
5,560,184 A 10/1996 Tisma
5,575,137 A 11/1996 Metz et al.
5,576,588 A 11/1996 Moribayashi et al.
5,581,984 A 12/1996 Domke et al.
5,584,166 A 12/1996 Lakey
5,657,610 A 8/1997 Dietrich et al.
5,669,201 A 9/1997 Simionato
5,685,131 A 11/1997 Spatolisano et al.
5,685,132 A 11/1997 Romijn et al.
5,694,745 A 12/1997 Spatafora et al.
5,715,656 A 2/1998 Pearce
5,727,365 A 3/1998 Lashyro et al.
5,727,366 A 3/1998 Manly, Jr.
5,746,043 A 5/1998 Terminella et al.
5,752,370 A 5/1998 Linkiewicz
5,753,067 A 5/1998 Fukuda et al.
5,768,861 A 6/1998 Slenders
5,778,641 A 7/1998 Simionato
5,787,680 A 8/1998 Tisma et al.
5,855,105 A 1/1999 Ferris
6,021,621 A 2/2000 Linkiewicz
6,052,971 A 4/2000 Malsam et al.
6,079,469 A 6/2000 Stirnkorb et al.
6,138,442 A 10/2000 Howard et al.
6,178,726 B1 1/2001 Takigawa
6,182,426 B1 2/2001 Pritchard
6,301,859 B1 10/2001 Nakamura et al.
6,367,230 B1 4/2002 Fukuda
6,378,277 B1 4/2002 Inoue et al.
6,408,596 B1 6/2002 Kammler

(56) References Cited

U.S. PATENT DOCUMENTS

| | | | |
|---|---|---|---|
| 6,524,434 | B1 | 2/2003 | Domke et al. |
| 6,553,744 | B1 | 4/2003 | Terminella et al. |
| 6,572,267 | B1 | 6/2003 | Forman |
| 6,574,943 | B2 | 6/2003 | Van Dam |
| 6,598,367 | B2 | 7/2003 | Nakagawa et al. |
| 6,604,343 | B2 | 8/2003 | Fukuda |
| 6,665,999 | B1 | 12/2003 | Dierl et al. |
| 6,725,629 | B2 | 4/2004 | Pearce et al. |
| 6,761,016 | B1 | 7/2004 | Soleri |
| 6,871,476 | B2 | 3/2005 | Tobolka |
| 6,932,751 | B1 | 8/2005 | Ward et al. |
| 6,966,166 | B2 | 11/2005 | Kissling |
| 6,986,232 | B1 | 1/2006 | Kume et al. |
| 7,000,366 | B2 | 2/2006 | Borghi et al. |
| 7,028,451 | B2 | 4/2006 | Braun et al. |
| 7,036,293 | B2 | 5/2006 | Kammler et al. |
| 7,069,707 | B2 | 7/2006 | Braun et al. |
| 7,069,709 | B2 | 7/2006 | Matheyka et al. |
| 7,121,067 | B1 | 10/2006 | Fukuda et al. |
| 7,299,604 | B2 | 11/2007 | Kammler et al. |
| 7,305,808 | B2 | 12/2007 | Fukuda et al. |
| 7,325,386 | B2 | 2/2008 | Kissling |
| 7,546,722 | B2 | 6/2009 | Tsuruta |
| 7,555,878 | B2 | 7/2009 | Brioschi |
| 8,539,741 | B2 | 9/2013 | Lubezny et al. |
| 2002/0104292 | A1 | 8/2002 | Tsuruta |
| 2002/0162305 | A1 | 11/2002 | Miyamoto et al. |
| 2003/0217531 | A1* | 11/2003 | Keen ..... B29C 65/18 53/552 |
| 2005/0155331 | A1 | 7/2005 | Matheyka et al. |
| 2005/0262812 | A1 | 12/2005 | Thorpe |
| 2005/0262815 | A1 | 12/2005 | Kuss et al. |
| 2006/0075724 | A1 | 4/2006 | Kammler et al. |
| 2006/0236659 | A1 | 10/2006 | Miyazawa et al. |
| 2007/0062158 | A1 | 3/2007 | Boldrini et al. |
| 2008/0066430 | A1 | 3/2008 | Lubezny |

* cited by examiner

ROTATABLE SEALING JAW ASSEMBLY FOR A FORM, FILL AND SEAL MACHINE

This application claims the benefit of U.S. Provisional Application Ser. No. 62/246,340, filed Oct. 26, 2015, the entire disclosures of which are hereby incorporated herein by reference.

FIELD OF THE INVENTION

The present invention relates generally to a rotatable sealing jaw assembly for a form, fill and seal machine, and in particular to a sealing jaw assembly that may be rotated 90 degrees between two different sealing positions, and to a method of converting the machine between two sealing configurations.

BACKGROUND

Form, fill and seal bag machines are configured to form packages of different shapes and sizes. Typically, the machine, in sequence, forms a tube from a roll of film and fills the tube with a product, for example a food product. A cross seal mechanism sequentially makes a cross seal, which simultaneously forms a top seal of one bag and a bottom seal of an immediately adjacent bag, such that the latter bag may be filled with the product. The cross seal is then cut to separate the bags.

Typically, form, fill and seal machines may run intermittently, wherein the formed bag is momentarily stopped for sealing and/or cutting, or continuously, wherein the sealing jaws and cutting knife travel with the formed bag to form the seal and separate the bags. Often, both types of machines may be set up such that the sealing jaws are oriented in specific configuration relative to a forming tube and vertical sealer. As such, the machines are limited in the type of bags that may be produced.

In other machines, the sealing jaws may be oriented in different configurations. Typically, however, the conversion between different configurations may be extremely labor intensive and time consuming, thereby leading to extended downtimes between bag changeovers.

SUMMARY

The present invention is defined by the following claims, and nothing in this section should be considered to be a limitation on those claims.

In one aspect, one embodiment of a form, fill and seal machine includes a support frame having an L-shaped track with first and second track portions. A sealing jaw assembly includes first and second guides moveable along the track from a first position, wherein the first and second guides are positioned in the first track portion, to a second position, wherein the first and second guides are positioned in the second track portion. The sealing jaw assembly is rotated 90 degrees as the first and second guides are moved from the first position to the second position.

In another aspect, a method of converting a form, fill and seal machine from a first configuration to a second configuration includes providing a support frame having an L-shaped track with first and second track portions, positioning first and second guides of a sealing jaw assembly in the first track portion, moving the first and second guides from the first track portion to the second track portion, and rotating the sealing jaw assembly 90 degrees as the first and second guides are moved from the first track portion to the second track portion.

The various embodiments of the rotatable sealing jaw assembly, and methods for the use thereof, provide significant advantages over other form, fill and seal machines, and components used therein. For example and without limitation, the sealing jaw assembly can be quickly and easily moved, or converted, from one sealing position or configuration to another sealing position or configuration. In this way, the same machine may be used to form different types of bags while minimizing downtime.

In addition, the L-shaped track is integrated into the frame, with no gaps or fasteners, such that sanitation is maximized when the machine is being used in food industry environments.

Moreover, the footprint of the machine may be minimized, in that the rotational reconfiguration of the sealing jaw assembly is performed with a minimal amount of deviation from a central axis of rotation defined by the sealing jaws. In other words, the assembly does not unnecessarily protrude in an X or Y direction during the rotational transition, such that the footprint of the frame may be minimized, which allows for greater density and efficiency on the processing floor.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction, and includes the direction of film movement through a form, fill and seal machine. The term "lateral," as used herein, means situated on, directed toward or running from side to side or front to back depending on an orientation of a sealing jaw assembly, and includes a direction transverse to the direction of film movement through a form, fill and seal machine. The term "coupled" means connected to or engaged with whether directly or indirectly, for example with an intervening member, and does not require the engagement to be fixed or permanent, although it may be fixed or permanent (or integral), and includes both mechanical and electrical connection. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. For example, a "first" guide or track may be later referred to as a "second" guide or track depending on the order in which they are referred. It should also be understood that designation of "first" and "second" does not necessarily mean that the two components or values so designated are different, meaning for example a first guide may be the same as a second guide, with each simply being applicable to different components.

U.S. Pat. Nos. 5,715,656, 5,752,370 and 8,539,741, assigned to Triangle Package Machinery Company, the same Assignee as the present application, disclose various components of form, fill and seal machines, the entirety of which patents are hereby incorporated herein by reference.

Figure 1A:
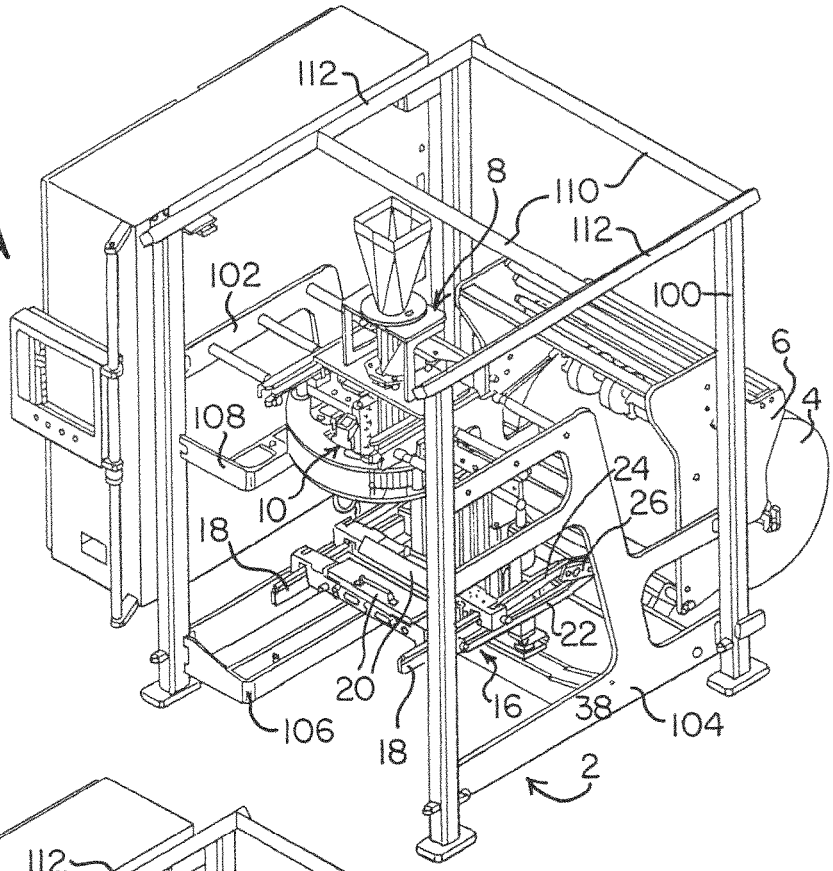
FIGS. 1A and B are perspective views of one embodiment of a form, fill and seal machine with a sealing jaw assembly in a first, standard position and a second, rotated position.
Figure 1B:
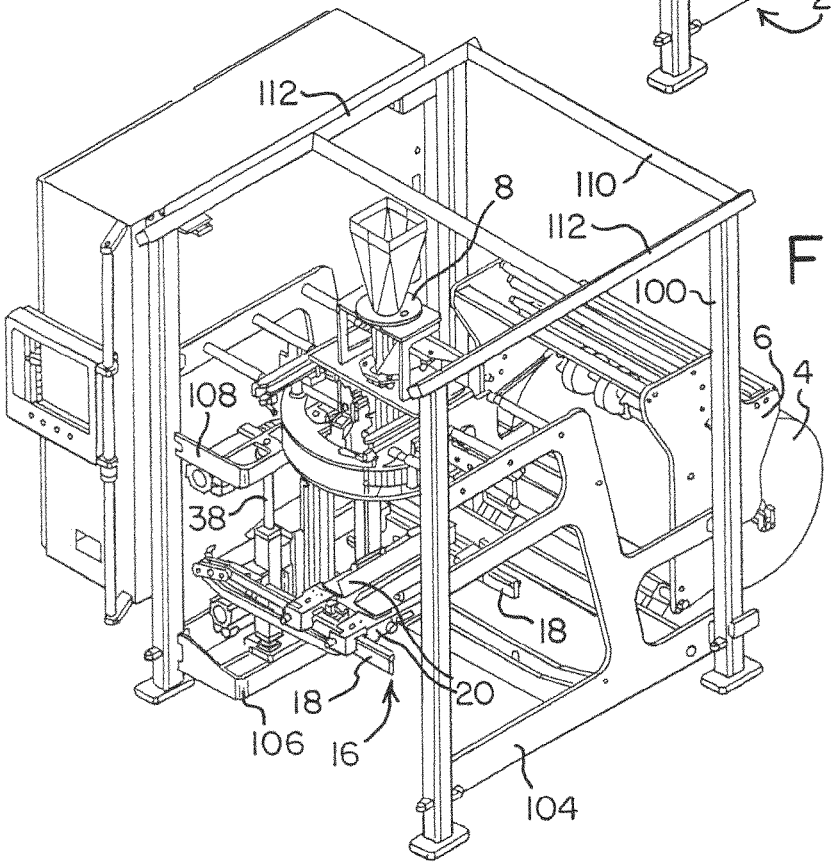
Figure 2A:
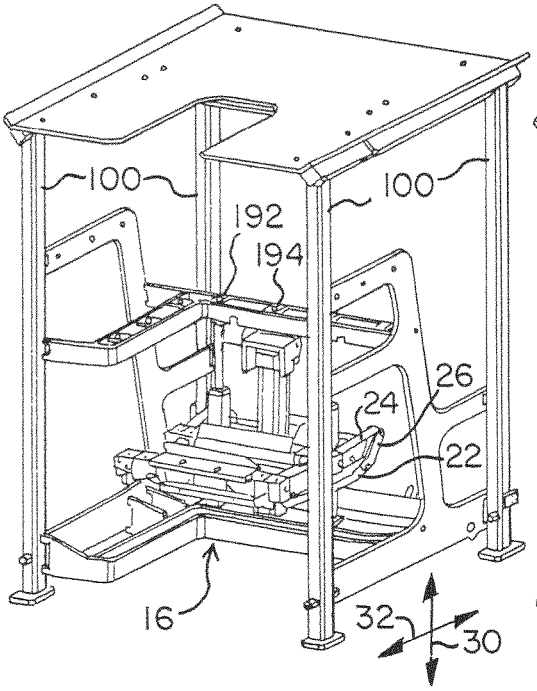
FIGS. 2A, B and C are perspective views of one embodiment of a frame with a sealing jaw assembly in a standard position, a transitioning position and a rotated position.
Figure 2B:
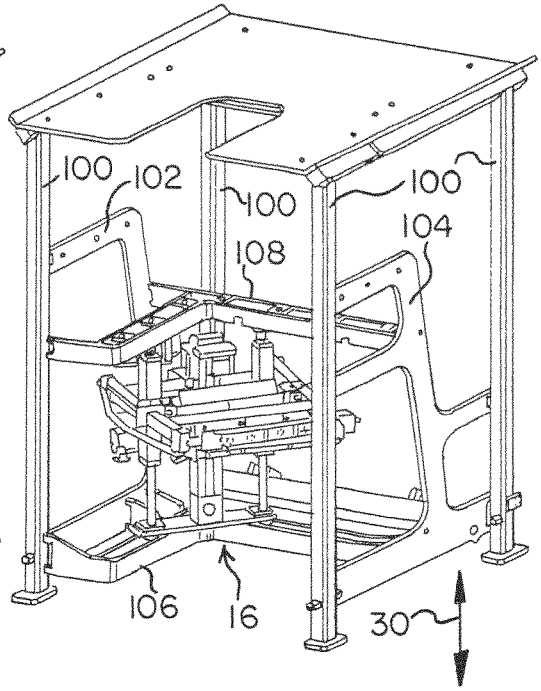
Figure 2C:
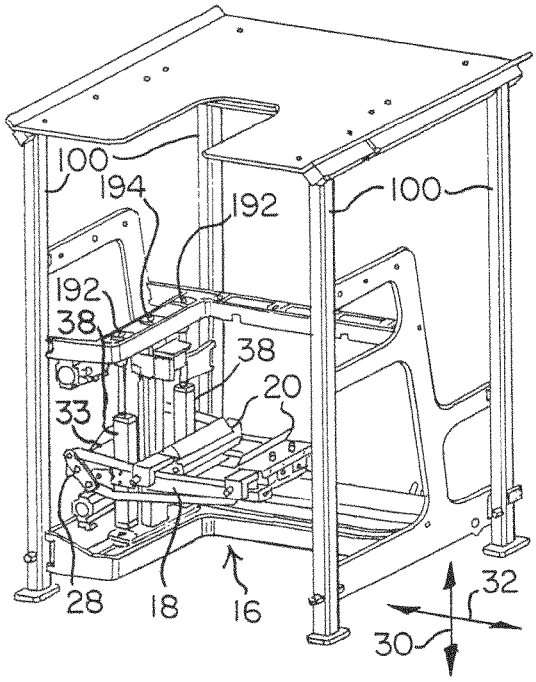
Figure 3:
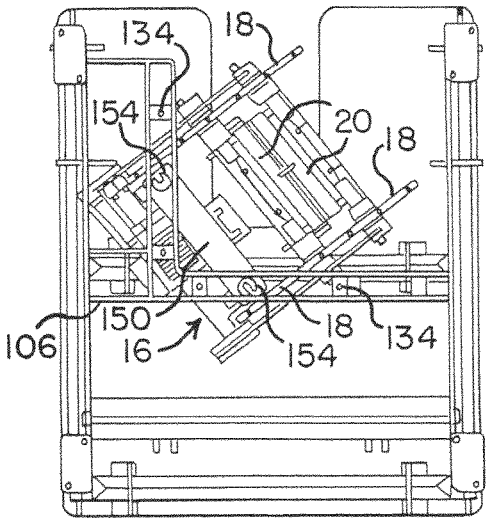
FIG. 3 is a bottom view of the frame and sealing jaw assembly in the transitioning position shown in FIG. 2B.

Form, Fill And Seal Machine:

Referring to FIGS. 1A and B, a form, fill and seal machine includes a frame 2 and a film cage 6 configured to hold and store rolls 4 of film. The film cage may include dancer rollers that control/maintain the tension of the film as it is introduced to the machine. The dancer rollers speed up or slow down the power unwind of the film from the film roll 4. The film is unrolled from the roll 4 and is guided to a forming shoulder 8, which forms the film into a tubular structure around a forming tube. As is well known in the art, packages of various shapes and sizes can be formed by changing the forming tube and forming shoulder. A vertical back sealer 10 seals the film to form a film tube. Product, including for example and without limitation various liquid or solid food products, is loaded through an open end of the forming tube into the film tube, which is sealed to form a bag filled with the product.

Frame:

Referring to FIGS. 1A-3 and 5A-9, the frame 2 includes four columns 100 and pair of side frame members 102, 104 joining the columns. Cross members 110, 112 join the four columns at upper ends thereof. Lower and upper L-shaped tracks 106, 108 span between and are secured to the side frame members, for example by welding. The tracks 106, 108 each include a plurality (shown as four or five) of flanges 114, each having a pair of locating tabs 116, which are welded to the columns and/or side frame members. In this way, the tracks 106, 108 are integral to the frame 2, thereby eliminating various gaps and fasteners and ensuring maximum sanitary conditions. The frame, including the tracks, may be made of stainless steel.

The lower track 106 has first and second track portions 118, 120, arranged orthogonally and which have a common junction 122. The track portions are defined by opposite side walls 124, 126 having top edges 148 and which are joined by a plurality of cross braces 128 (shown as five) along a bottom of the side walls so as to form upwardly opening channels 130, 132. A stop 134 is secured to the distal cross brace 128 in each of the first and second track portions. The stops 134 extend upwardly into the channels 130, 132.

The upper track 104 also has first and second track portions 136, 138 (otherwise referred to as third and fourth track portions), arranged orthogonally and which have a common junction 140. The upper track is vertically spaced from, and overlies, the lower track in an aligned configuration. The track portions 136, 138 are defined by opposite side walls 142, 144 which are joined by a plurality of cross braces 146 along a top of the side walls so as to form downwardly opening channels 145, 147. In one embodiment, the upper track includes at least three cross braces spaced apart along each of the track portions.

Figure 11:
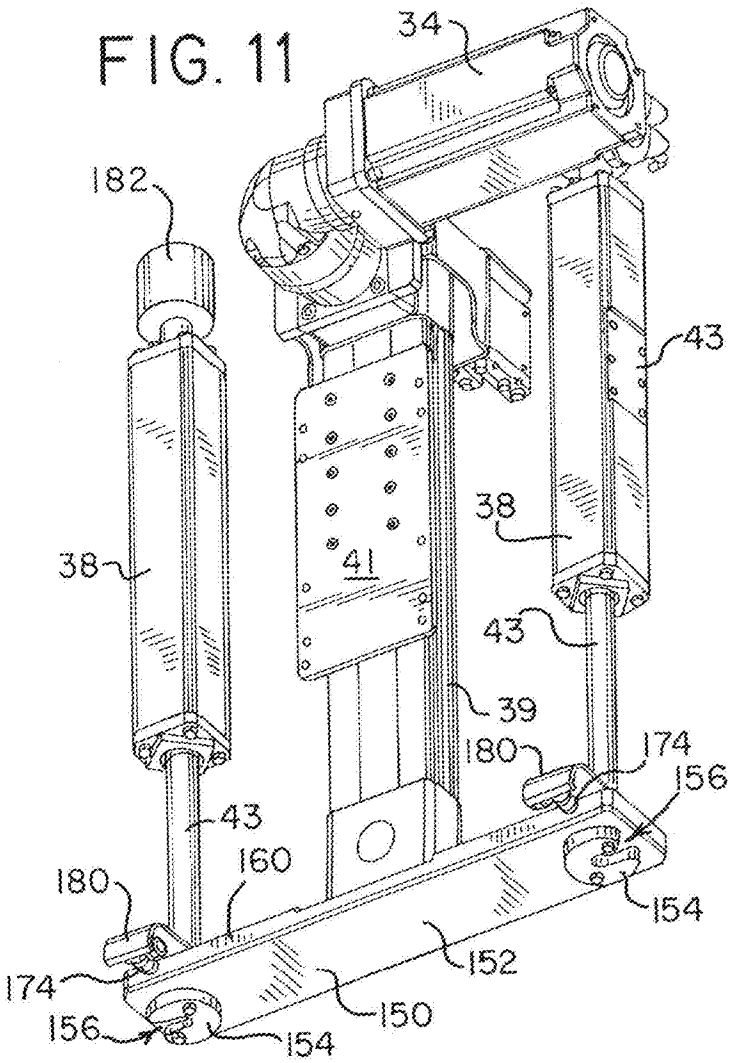
FIG. 11 is a bottom perspective view of a sealing jaw assembly.
Figure 10:
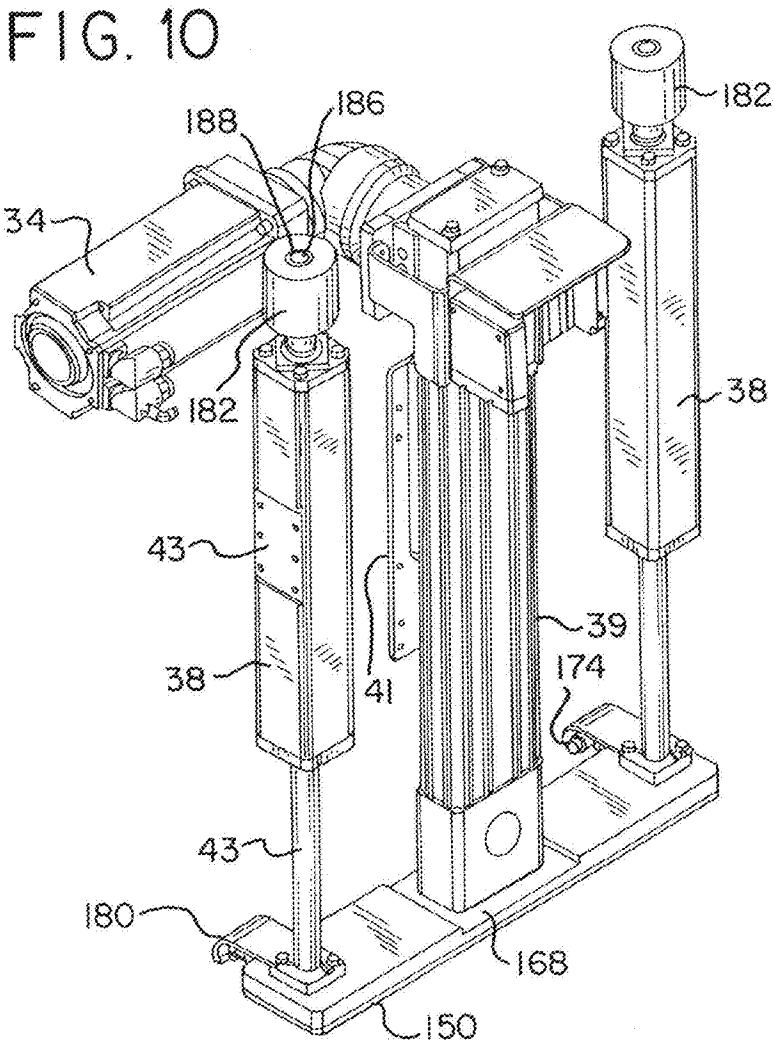
FIG. 10 is a top perspective view of a sealing jaw assembly.

Sealing Jaw Assembly:

Referring to FIG. 1A-4F, one embodiment of a sealing jaw assembly 16 is shown. In this embodiment, which is for a "continuous" motion machine, the assembly 16 includes a drive system having a pair of rails 18 that carry a pair of jaws 20. The jaws 20 are moved together and apart on the rails by a pair of arms 22, 24, which are driven in turn by a pivot lever 26. A servo motor 33 rotates the pivot lever 26 in opposite first and second rotational directions so as to move the jaws 20 toward and away from each other as the jaws are supported by the rails. The rails 18 and jaws 20 are carried by, and move vertically with, a carriage assembly 28 in a longitudinal direction 30. The carriage is mounted on a pair of linear guides, shown as air cylinders 38 in this embodiment, which slide along a guide rod 43. A central column, or linear actuator 39, includes a servo belt drive, configured with a servo motor 34 and belt 36 with air assist. The linear actuator 39 moves the carriage assembly 28 up and down in the longitudinal direction 30 on the air cylinders 38. Referring to FIGS. 10 and 11, the carriage (not shown) is secured to a plate 41 on the linear actuator and to the sides 43 of the air cylinders. The air cylinders 38 provide a damping system for the carriage system of air pressure. As such, the carriage assembly 28 can move with the air cylinders at high speeds and accelerations with reduced wear and tear on the system. In addition, the jaws 20 can be moved toward and away from each other in a lateral direction 32 independently of the vertical movement of the carriage assembly 28 by actuation of the motor 33 that is coupled to the pivot lever. As shown in FIGS. 2A and C, the lateral direction 32 shifts from front-to-back to side-to-side as the sealing jaw assembly is rotated relative to the frame 2. The movement of the carriage assembly and the actuation of the jaws are programmable, and can be configured or operated by a controller, such as a computer, having a user interface. In one embodiment, the systems is controlled by Rockwell Automation's ControlLogix, with a touchscreen human-machine interface.

The jaws 20 are configured with a sealing device and a film separation device. The sealing device is mounted to one of the jaws between upper and lower grippers. The sealing device, in one embodiment, has a length equal to or greater than the width of the film tube 12. The sealing device may be configured as a heat seal bar, an ultrasonic sealing device or other suitable sealing device. In one embodiment, the sealing device is configured as an insert, which is secured to the carriage with a quick-release mechanism, including for example and without limitation removable pins. The film separation device is mounted to at least one of the jaws between the upper and lower grippers. The film separation device, in one embodiment, has a length equal to or greater than the width of the film tube 12. The film separation device is configured in one embodiment as a cutting device, such as a knife, secured to one of the opposing carriages. It should be understood that the film separation device can include other types of cutting devices including without limitation air and water jets, hot wire, die, shear, ultrasonic devices, and/or combinations thereof, positioned between the upper and lower grippers. In one embodiment, the film separation device is secured to the jaw with a quick-release mechanism, including for example and without limitation removable pins. The film separation device is laterally moveable relative to the jaw with an actuation cylinder from a cutting position to a retracted position.

Figure 12:
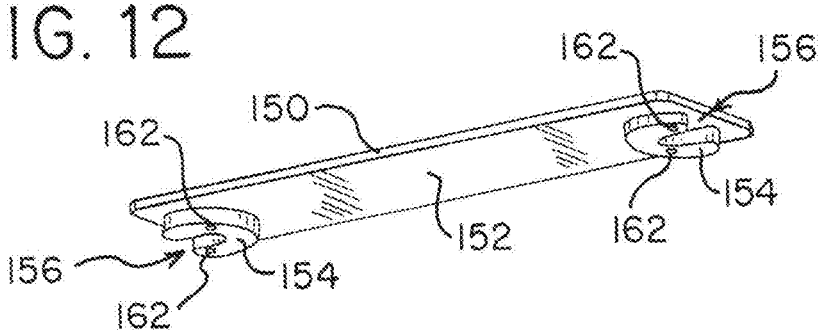
FIG. 12 is a perspective view of a slide plate with first and second guides disposed thereon.
Figure 13:
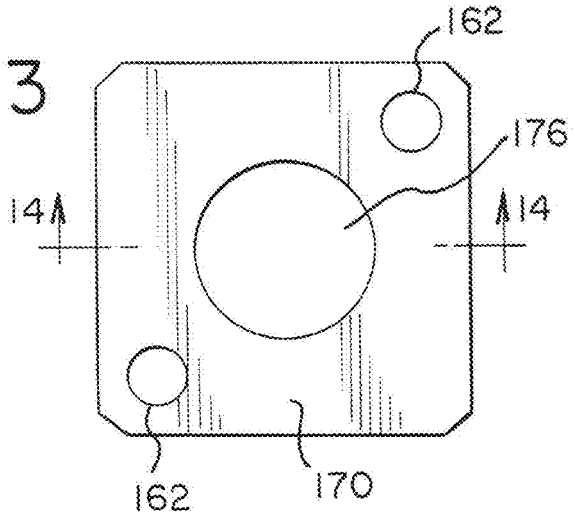
FIG. 13 is a plan view of a retainer plate.
Figure 14:
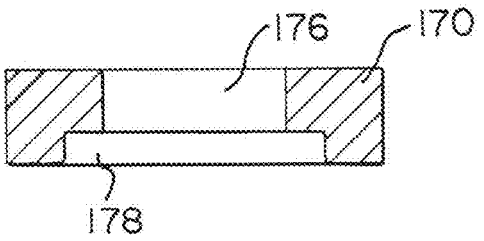
FIG. 14 is a cross-sectional view of the retainer plate taken along line 14-14 of FIG. 13.

Referring to FIG. 10-12, the sealing jaw assembly also includes a slide plate 150 coupled to the linear actuator 39 and air cylinders 38. The slide plate has a bottom surface 152 that rides along the top edges 148 of the lower track side walls. The slide plate 150 is made of a material having a low coefficient of friction, such as ultra-high molecular weight polyethylene. A pair of guides 154, or sliders, are machined from, and extend downwardly from the bottom surface of the slide plate. Alternatively, the guides may be made separately and secured to the slide plate with fasteners, adhesives and/or combinations thereof. The guides 154 each have a generally circular profile and dimensioned to fit inside the channels 130, 132 of the lower track, with the guides engaging and sliding along the inner surface of the opposite side walls 124, 126. Each guide 154 has a radially extending slot 156, or channel, opening outwardly toward an end of the slide plate and aligned with a longitudinal axis of the plate and each other. The slots 156 are dimensioned to receive and engage the stop 134, with one of the guides engaging the stop in one track portion 118, and the other guide engaging the other stop in the other track portion 120.

It should be understood that the slide plate may be arranged to slide along the upper track, which may be configured with stops in the third and fourth track portions.

Figure 15:
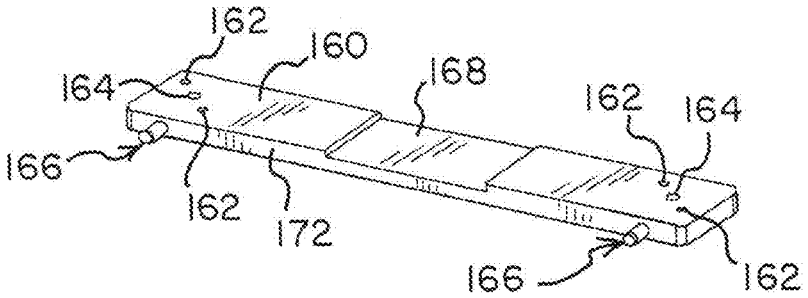
FIG. 15 is a perspective view of a base plate.

As shown in FIGS. 10, 11 and 15, the sealing jaw assembly also includes a base plate 160 secure to a top of the slide plate 150. The two plates 150, 160, and a retainer member 170, include mating fastener openings 162, such that they may be coupled together. The base plate is made of stainless steel. The base plate has a middle platform 168 dimensioned to support a bottom of the linear actuator 39. The base plate also has a pair of vertically aligned openings 164 opening to a top of the base plate, which are in fluid communication with a pair of laterally extending air inlet passageways 166 that open through a side 172 of the base plate. The term "fluid" means a liquid or gas, such as air. A nipple or fitting 174, or other air hose adapter, is coupled to the side of the base plate in sealing communication with the air inlet passageway. The fitting may be configured with a valve, and/or an air supply hose may be releasably coupled thereto, so that the air cylinders may be properly charged or pressurized.

Referring to FIGS. 10, 11, 13 and 14, the retainer member 170 has a through opening 176, and a larger recessed opening 178 aligned with the through opening. The air cylinder rod 43 extends through the through opening 176, with a foot portion of the air cylinder rod disposed in the recessed opening 178. The retainer member 170 is secured to a top of the base plate 160 with the air cylinder foot biased against the base plate. A seal, such as an O-ring, may be disposed between the retainer and the base plate to prevent air leakage and maintain pressurized air within the air cylinder. The circular profile O-ring is disposed in the counterbore space 178 and makes two seals at once, both between the retainer and the base plate and between the air cylinder and the base plate. A guard 180 is connected to a top of the retainer member and has a curved portion wrapping around the fitting to prevent it from being damaged, or contaminated.

Referring to FIGS. 2A-C, 10 and 11, a guide 182, or slider, is secured to the top of each air cylinder 38. The guides 182 are disposed in one or both of the channels 145, 147 of the upper track. The guides 182 may be made of ultra-high molecular weight polyethylene. The guides 182 have a circular profile and engage the inner surface of the side walls 142, 144. The top of each air cylinder, or guide, has an opening 188 in which a spring 186, e.g., polyurethane, is disposed. The openings 188 of the guides are aligned with openings 190 in the cross-brace members when the sealing jaw assembly is in a first or second position as further explained below, with one of the lower guides engaged with a respective stop member.

A fastener 192, such as a bolt, is threadably engaged with the cross-brace member 146 with the end of the bolt compressing the spring 186 (die and disc) and clamping the air cylinder 38 between the upper and lower tracks 102, 104. A spring is used in this location instead of a hard bolted connection to prevent the loosening of the bolts due to vibration. Alternatively, Loctite or a jam nut may be used. However, Loctite is not suitable for a connection that needs to be fastened and unfastened frequently, and jam nuts increase the complexity of the assembly. The spring 186 is compressed between 10 and 25% of its length as the fastener 192 is installed, such that the spring absorbs the vibration caused by the reciprocating forces and ensures that the compressive force is consistent, thereby preventing the fastener from vibrating loose. The spring 186 also prevents damage to the cylinder due to over-torquing of the fasteners 192.

A fastener 194, such as a bolt, also extends through a third, intermediate cross brace and engages the top of the linear actuator, further stabilizing the system. A spring may also be incorporated for the same reasons just stated. In one embodiment, the linear actuator has disc springs, while the air cylinders have polyurethane springs, although it should be understood that either type or spring may work in all locations, and that other types of springs and materials may also be suitable.

It should be understood that the three fasteners may alternatively be configured as clamps, pins or levers, or other suitable devices, and may be manually manipulated, for example with a wrench, lever (e.g., quick release), cam or other tool, or by automated manipulation, whether by pneumatic or electro-mechanical actuation, e.g., axial movement of location pins into engagement with the air cylinders and/or linear actuator.

It should be understood that only a single track, e.g., lower or upper, is required for operation, with lower and upper guides running in the single track. At the same time, a slide plate may simply slide along a lower or upper support surface, not necessarily configured as a track, or may slide along a surface of an upper track, with the weight of the sealing jaw assembly being carried by the upper track rather than the lower track. In addition, while the sealing jaw assembly disclosed is for a "continuous" sealing jaw assembly, it should be understood that the track(s) may also be suitable to rotate or transition an "intermittent" sealing jaw assembly if configured with guides to move along one or more of the track portions as described herein. It should be understood that the phrase "sealing jaw assembly" refers to any structure capable of supporting one or more sealing jaws, and that the "sealing jaw assembly" may (see FIG. 2A) or may not (see FIG. 10) include the sealing jaw(s) as part of the assembly.

Rotation of Sealing Jaw Assembly:

In operation, the sealing jaw assembly may be moved, or rotated, from a first, standard position, to a second, rotated position as shown in FIGS. 1A-4F. For example, in the first position, the sealing jaw assembly 16 is particularly well suited to run pillow, gusset, flat bottom, transverse zipper, and four corner bags, while in the second position, the sealing jaw assembly is well suited to run 3-sided, longitudinal zipper, and doyen style bags, although it should be understood that the sealing jaw assembly is not limited to run only these types of bags, and that other types of bags may also be run in one or both of the noted positions. In this way, the same form, fill and seal machine may be used to run a variety of different bags and products. The changeover from one position to the other can be done very quickly, for example in less than 10 minutes.

Figure 4A:
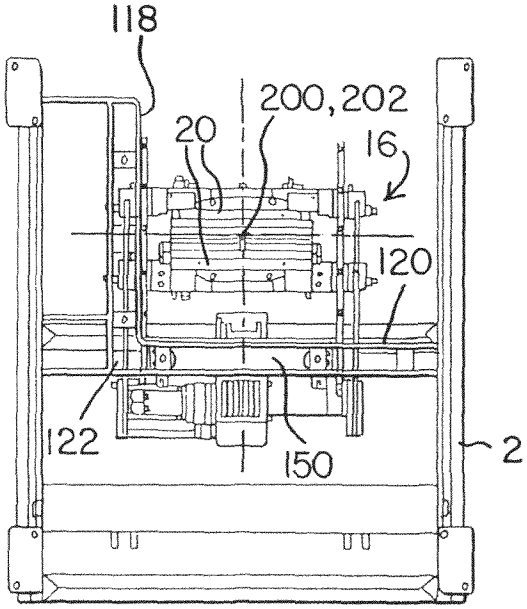
FIGS. 4A-F are bottom views showing the transitioning sequence of the sealing jaw assembly from a first, standard position to a second, rotated position.
Figure 4B:
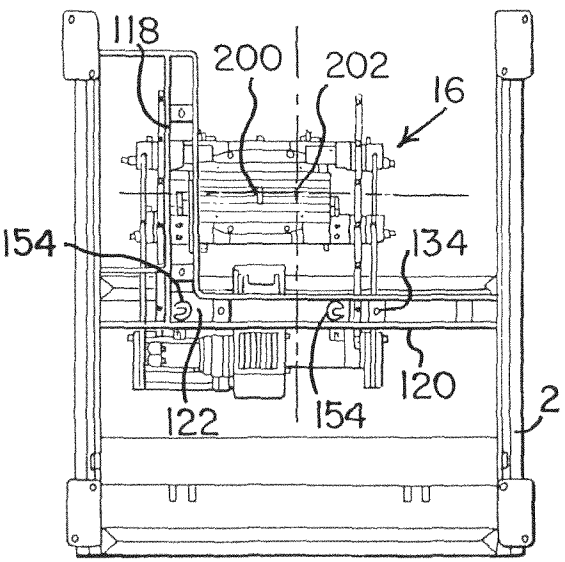
Figure 4C:
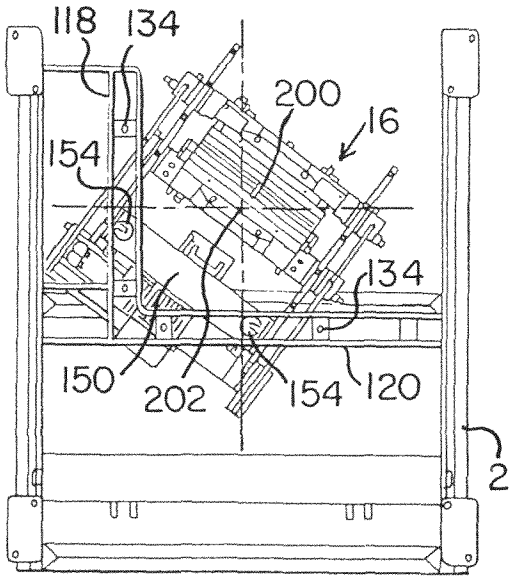
Figure 4F:
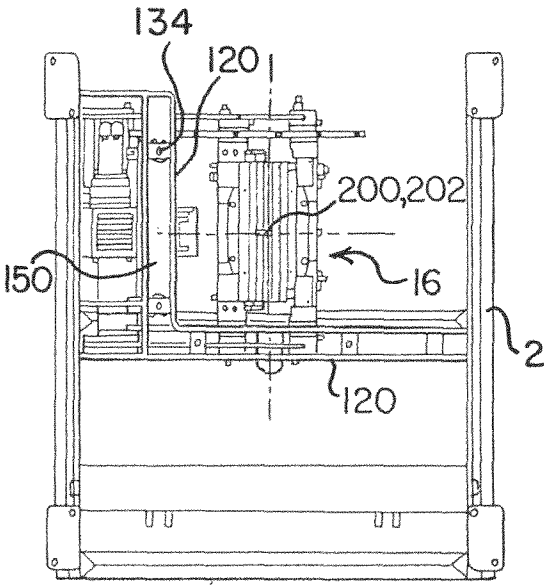
Figure 4E:
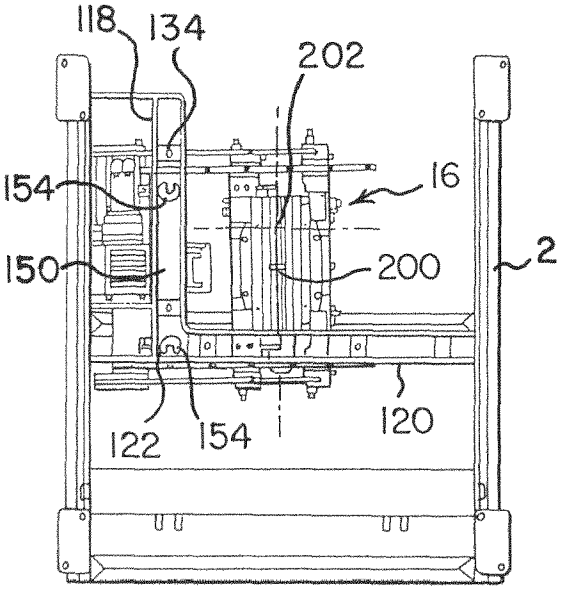
Figure 4D:
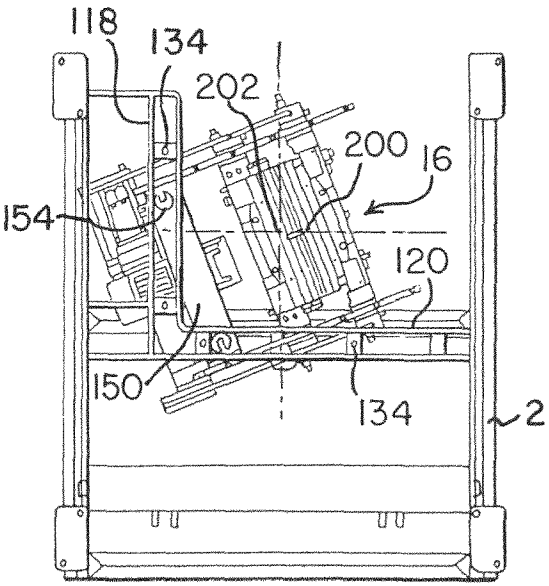
Figure 5B:
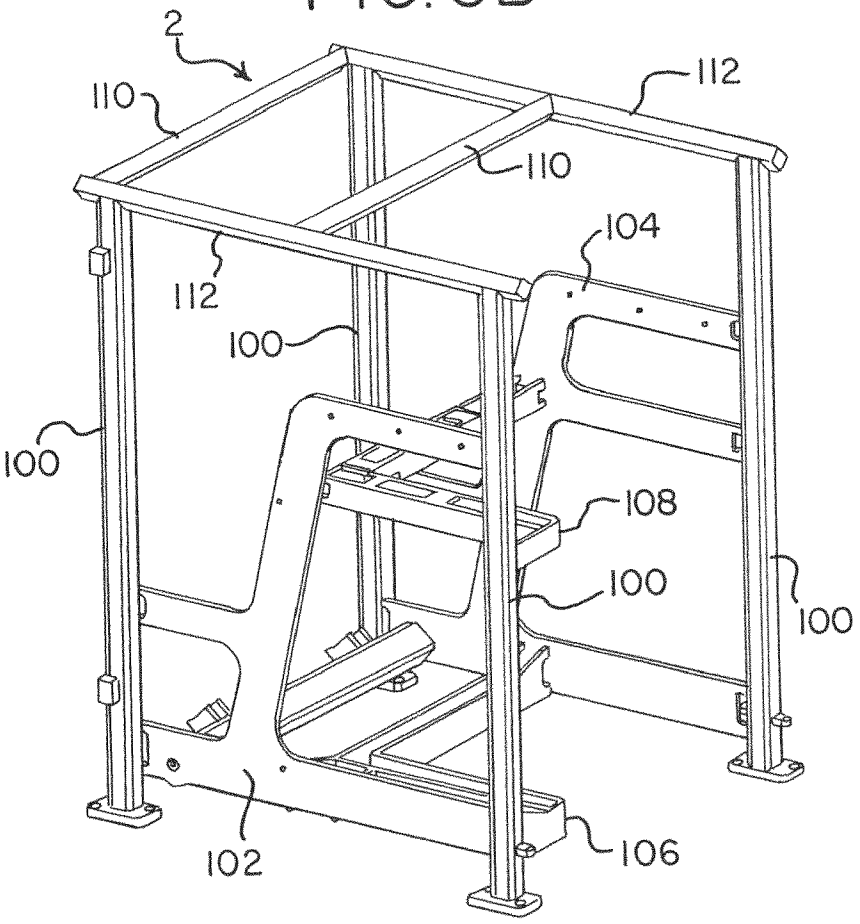
FIGS. 5A and B are right and left perspective views of the frame.
Figure 5A:
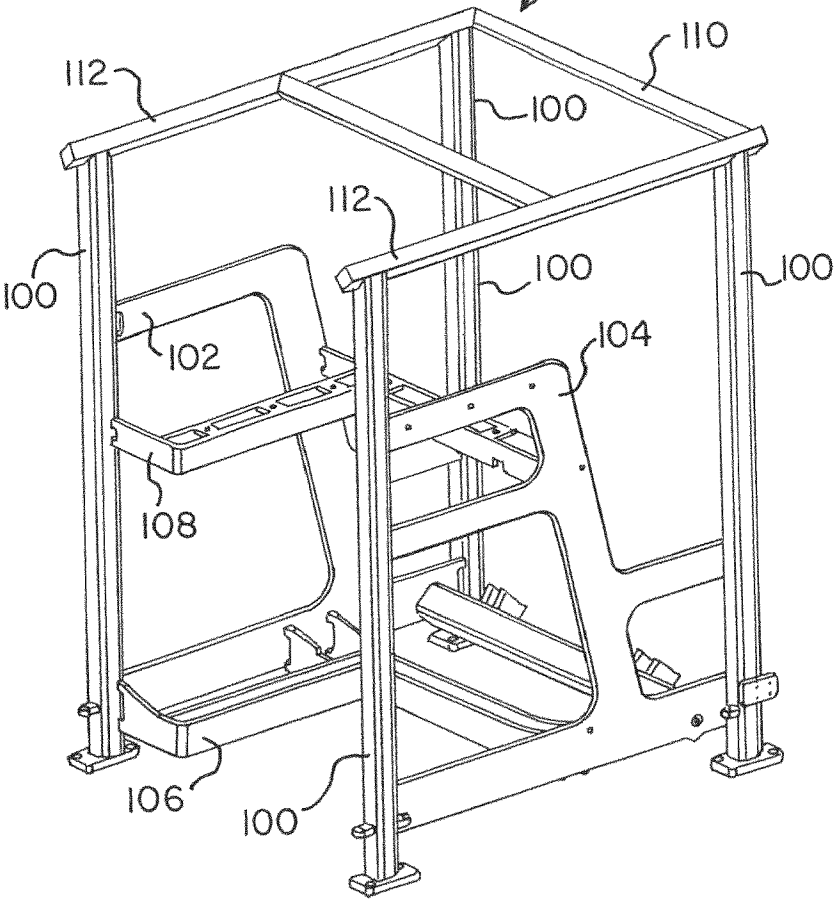
Figure 7:
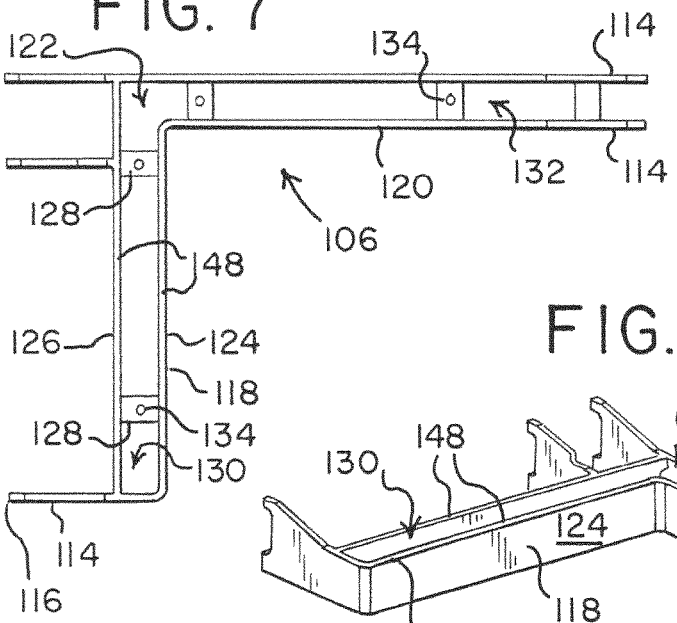
FIG. 7 is a plan view of the track shown in FIG. 6.
Figure 6:
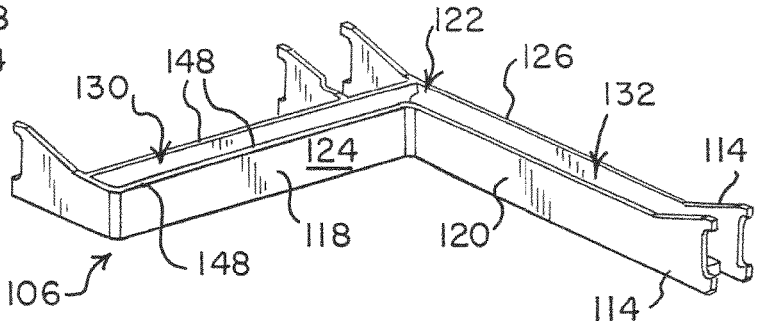
FIG. 6 is a top, perspective view of a lower L-shaped track.
Figure 9:
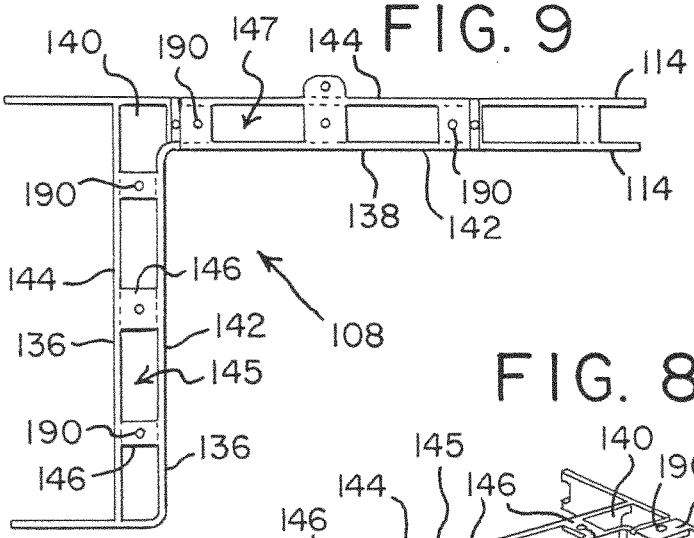
FIG. 9 is a plan view of the track shown in FIG. 8.
Figure 8:
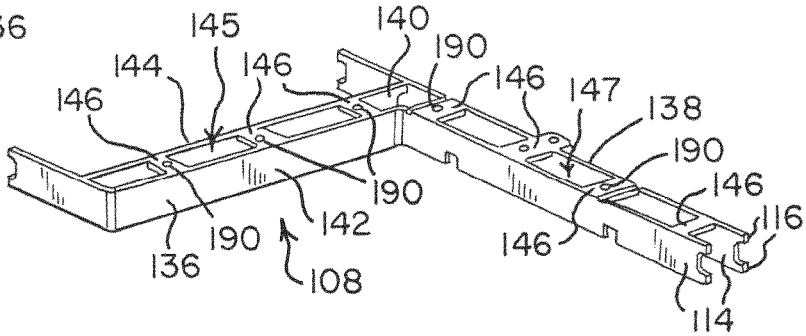
FIG. 8 is a top, perspective view of a lower L-shaped track.

To perform the transition, the operator first loosens, or disengages the three fasteners 192, 194 engaging the air cylinders/guides and the linear actuator in one of the upper track portions 120, 138 (see FIG. 4A), whether manually or by automated actuation. After the fasteners are disengaged, the sealing jaw assembly 16 is moved or translated in the tracks 102, 104, by sliding the upper and lower guides 182, 154 in the track portions 138, 120, until the leading guides (upper and lower) are disposed in the junctions 140, 122 (see FIG. 4B). The movement of the sealing jaw assembly may be effected manually, e.g., by grasping and pulling/pushing the sealing jaw assembly by hand, or automatically, e.g., by pushing/pulling with an actuator, such as a cable or push rod. The sealing jaw assembly then starts to move or pivot as the leading upper/lower guides 182, 154 are moved along the second track portion 136, 118 while the following set of upper/lower guides are moved along the first track portion 138, 120 (FIGS. 4C and D). It should be understood that the terms "lead" or "leading" refer to the guides moving in front of the other "following" guides in the direction of travel, with one set of upper and lower guides "leading" during a transition from a first to a second position, and then "following" during a transition back from the second position to the first position. When the following upper and lower guides 182, 154 reach the junction 140, 122 (FIG. 4E), the sealing jaw assembly may then be moved or translated along the second track portion 136, 118 to the second position, with the stop 134 engaging the leading lower guide 154 when received in the slot 156 thereof (FIG. 4F). In this position, the air cylinders and linear actuator are aligned with the cross-braces 146 in the second upper track portion, such that the fasteners 192, 194 may be reengaged therewith to secure or clamp the sealing jaw assembly in the new position. As shown in FIGS. 4A and F, the sealing jaw assembly has been rotated 90 degrees between the first and second positions, yet the center point 200 of the sealing jaws is at the same operation axis 202 in each of the first and second positions. Moreover, during the transition, the center point 200 moves a maximum of 3.5 inches from the operation axis 202. In this way, rotation of the sealing jaw assembly is achieved in a very small footprint, which minimizes the overall footprint of the machine and the spacing between the side frame members, and the front and back of the frame.

Bag Forming Operation:

In operation, and with reference to FIGS. 1A and B, the carriage assembly 28 is moved in the vertical (or longitudinal) direction 30 at the same speed and velocity as the film tube 12. The jaws 20 are closed by moving the pivot lever 26, which drives the jaws together, with the upper and lower grippers gripping the film tube 12. The sealing devices are then moved laterally toward each other to form a cross seal as the grippers are biased against the force of the springs, thereby closing and sealing the film tube 12 as the jaws move at the same velocity as the film tube. In this way, the sealing device is moved laterally relative to the grippers.

In one embodiment, the jaws have top and bottom sealing surfaces, with a film separation device, configured as a knife in one embodiment, located between the top and bottom surfaces. The film separation device fires through the film after the seal is made. The grippers may maintain a grip on the film as the film separation device is actuated in one embodiment. In an alternative embodiment, the jaws 20 may open a slight distance, for example about 10-15 mm, and move at a different velocity relative to the film tube 12 until the film separation device is aligned with the seal and the sealing device is moved out of alignment with the seal, whereinafter the jaws 20 are then closed again. With the upper and lower grippers again gripping the film tube 12, the film separation device is actuated, for example by moving the cutting device laterally to thereby cut the film tube across the seal. Alternatively, the jaws can be closed with an extended knife so as to make the cut while moving with the film, preferably proximate the longitudinal centerline of the seal.

The film tube is filled with product after a first lower seal is made and before a next upper seal is formed. After the film tube is filled, the next upper seal is formed to thereby form a bag of product, and the cut is made across the seal to separate the filled bag from the film tube above. In this way, the filled bag is sealed at the top and bottom thereof all of the way to the edges thereof, which edges are formed by the cut sequence. The sequence of the seal formation, carriage shift and cut may be accomplished in several alternative ways.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A form, fill and seal machine comprising:

a support frame comprising an L-shaped track having first and second track portions; and a sealing jaw assembly comprising first and second guides moveable along said track from a first position, wherein said first and second guides are positioned in said first track portion, to a second position, wherein said first and second guides are positioned in said second track portion, and wherein said sealing jaw assembly is rotatable 90 degrees as said first and second guides are moved from said first position to said second position.

2. The form, fill and seal machine of claim 1 further comprising a slide plate sliding on an upper surface of said L-shaped track, wherein said first and second guides are disposed on said slide plate, and wherein said sealing jaw assembly is supported by said slide plate.

3. The form, fill and seal machine of claim 2 wherein said L-shaped track comprises a lower L-shaped track, and wherein said support frame further comprises an upper L-shaped track vertically spaced above said lower L-shaped track, said upper L-shaped track having third and fourth track portions vertically spaced above and aligned with said first and second track portions respectively, and wherein said sealing jaw assembly further comprises third and fourth guides moveable along said upper L-shaped track from a first position, wherein said third and fourth guides are positioned in said third track portion, to a second position, wherein said third and fourth guides are positioned in said fourth track portion.

4. The form, fill and seal machine of claim 3 wherein said sealing jaw assembly comprises first and second air cylinders coupled between said slide plate and said third and fourth guides, wherein said sealing jaw assembly further comprises sealing jaws moveably supported by said first and second air cylinders.

5. The form, fill and seal machine of claim 4 wherein said sealing jaw assembly further comprises a linear actuator supported by said slide plate and extending between said upper and lower L-shaped tracks, wherein said sealing jaws are vertically movable in response to movement of said linear actuator.

6. The form, fill and seal machine of claim 4 further comprising a pair of fasteners releasably coupling said upper L-shaped track and said first and second air cylinders when said third and fourth guides are in each of said first and second positions.

7. The form, fill and seal machine of claim 4 further comprising a base plate disposed between said slide plate and said first and second air cylinders, wherein said base plate comprises an air inlet passageway in fluid communication with each of said first and second air cylinders.

8. The form, fill and seal machine of claim 7 further comprising a retainer member coupling a lower end of each of said first and second air cylinders to said base plate.

9. The form, fill and seal machine of claim 1 further comprising a first stop disposed in said first track portion and a second stop disposed in said second track portion, said first stop engaging said first guide when said first and second guides are in said first position and said second stop engaging said second guide when said first and second guides are in said second position.

10. The form, fill and seal machine of claim 9 wherein said first and second guides each have a circular profile and a radially extending slot, wherein said first and second stops are received in said radially extending slot of said first and second guides when said first and second guides are in said first and second positions respectively.

11. The form, fill and seal machine of claim 1 wherein said track is stationary and wherein said first and second track portions are orthogonal.

12. The form, fill and seal machine of claim 1 wherein said sealing jaw assembly is rotatable 90 degrees about a vertical axis as said first and second guides are moved from said first position to said second position.

13. A method of converting a form, fill and seal machine from a first configuration to a second configuration comprising:

providing a support frame comprising an L-shaped track having first and second track portions; and positioning first and second guides of a sealing jaw assembly in said first track portion;

moving said first and second guides from said first track portion to said second track portion; and rotating said sealing jaw assembly 90 degrees as said first and second guides are moved from said first track portion to said second track portion.

14. The method of claim 13 wherein said moving said first and second guides further comprises sliding a slide plate on an upper surface of said L-shaped track, wherein said first and second guides are disposed on said slide plate, and further comprising supporting said sealing jaw assembly with said slide plate.

15. The method of claim 14 wherein said L-shaped track comprises a lower L-shaped track, and wherein said support frame further comprises an upper L-shaped track vertically spaced above said lower L-shaped track, said upper L-shaped track having third and fourth track portions vertically spaced above and aligned with said first and second track portions respectively, and further comprising positioning third and fourth guides of a sealing jaw assembly in said third track portion, and moving said third and fourth guides from said third track portion to said fourth track portion.

16. The method of claim 15 wherein said sealing jaw assembly comprises first and second air cylinders coupled between said slide plate and said third and fourth guides, and further comprising movably supporting said sealing jaws with said first and second air cylinders.

17. The method of claim 16 wherein said sealing jaw assembly further comprises a linear actuator supported by said slide plate and extending between said upper and lower L-shaped tracks, and further comprising reciprocally actuating said linear actuator and reciprocally moving said sealing jaws vertically on said first and second air cylinders.

18. The method of claim 16 further comprising releasably coupling said first and second air cylinders to said upper L-shaped track with a pair of fasteners when said third and fourth guides are in each of said first and second positions.

19. The method of claim 16 further comprising disposing a base plate between said slide plate and said first and second air cylinders, and supplying air to said first and second air cylinders through an air inlet passageway formed in said base plate.

20. The method of claim 19 further comprising coupling a bottom end of each of said first and second air cylinders to said base plate with a retainer member.

21. The method of claim 13 further comprising engaging a first stop disposed in said first track portion with said first guide when said first and second guides are in said first position, and engaging a second stop disposed in said second track portion with said second guide when said first and second guides are in said second position.

22. The method of claim 21 wherein said first and second guides each have a circular profile and a radially extending slot, and wherein said engaging said first stop with said first guide and engaging said second stop with said second guide comprises inserting said first and second stops in said radially extending slots of said first and second guides respectively.

23. The method of claim 13 wherein said track is stationary and wherein said first and second track portions are orthogonal.

24. The method of claim 13 wherein said rotating said sealing jaw assembly 90 degrees as said first and second guides are moved from said first track portion to said second track portion comprises rotating said sealing jaw assembly 90 degrees about a vertical axis.

* * * * *